US011692233B2

(12) United States Patent
Zhang et al.

(10) Patent No.: US 11,692,233 B2
(45) Date of Patent: Jul. 4, 2023

(54) VACUUM SOLID SOLUTION METHOD FOR NICKEL-FREE HIGH MANGANESE AND NITROGEN STAINLESS STEEL

(71) Applicant: Shenzhen Pacific Union Precision Manufacturing Co., Ltd., Guangdong (CN)

(72) Inventors: Xinfang Zhang, Guangdong (CN); Yuancheng Zhou, Guangdong (CN); Hu Yang, Guangdong (CN); Chunwei Hou, Guangdong (CN)

(73) Assignee: Shenzhen Pacific Union Precision Manufacturing Co., Ltd., Guangdong (CN)

( * ) Notice: Subject to any disclaimer, the term of this patent is extended or adjusted under 35 U.S.C. 154(b) by 236 days.

(21) Appl. No.: 17/238,227

(22) Filed: Apr. 23, 2021

(65) Prior Publication Data

US 2021/0332451 A1 Oct. 28, 2021

(30) Foreign Application Priority Data

Apr. 24, 2020 (CN) ..... 202010336615.7

(51) Int. Cl.

| | |
|---|---|
| ***C21D 6/00*** | (2006.01) |
| ***C21D 1/773*** | (2006.01) |
| ***C22C 38/38*** | (2006.01) |
| ***C22C 38/00*** | (2006.01) |

(52) U.S. Cl.
CPC ..... *C21D 6/005* (2013.01); *C21D 1/773* (2013.01); *C21D 6/002* (2013.01); *C22C 38/001* (2013.01); *C22C 38/38* (2013.01); *C21D 2211/001* (2013.01); *C21D 2211/005* (2013.01)

(58) Field of Classification Search
CPC ..... C21D 1/773; C21D 2211/001; C21D 2211/005; C21D 6/002; C21D 6/005; C22C 38/001; C22C 38/38; F25D 25/04
See application file for complete search history.

(56) References Cited

U.S. PATENT DOCUMENTS 3,969,109 A 7/1976 Tanczyn

FOREIGN PATENT DOCUMENTS

| | | |
|---|---|---|
| CN | 106399838 | 2/2017 |
| CN | 108588578 | 9/2018 |

*Primary Examiner* — Jenny R Wu
(74) *Attorney, Agent, or Firm* — Cooper Legal Group, LLC

(57) ABSTRACT

A vacuum solid solution method for nickel-free high manganese and nitrogen is provided and relates to the technical field of metal material heat treatment. By vacuumizing, heat homogenizing, keeping the temperature in the final temperature range, deoxidation, and rapid cooling treatment, the present method forms a single austenitic structure from the raw materials, and promotes full and uniform dispersion of nitrogen carbide, providing a nickel-free high nitrogen stainless steel with more stable comprehensive performance and wider range of application.

5 Claims, 7 Drawing Sheets

VACUUM SOLID SOLUTION METHOD FOR NICKEL-FREE HIGH MANGANESE AND NITROGEN STAINLESS STEEL

CROSS-REFERENCE TO RELATED APPLICATION

This application claims the priority benefit of China Application No. 202010336615.7, filed on Apr. 24, 2020. The entirety of the above-mentioned patent application is hereby incorporated by reference herein and made a part of this specification.

BACKGROUND

Technical Field

The application relates to the technical field of metal material heat treatment, and more particular to a heat treatment method for stainless steel material, especially a vacuum solid solution method for nickel-free high manganese and nitrogen stainless steel.

Description of Related Art

With the wide use of stainless steel, more and more facts show that Ni elements in Ni stainless steel will be precipitated out continuously during use, which leads to allergic reaction to human body, slight radiation of Ni, or damage to human body due to widely used tableware and surgical medical devices. In the early 21st century, most countries in the EU began to limit the use of Ni containing stainless steel by legislation, and it is expected that in the future more and more countries will limit the use of Ni element in daily life. Meanwhile, as a precious metal, the use of Ni will cause huge use cost of stainless steel containing nickel. As a strong austenite element, N element can replace the role of Ni in stainless steel, while greatly improving the mechanical performance and corrosion resistance of steel (the solid solution presence of N element improves point corrosion resistance and intergranular corrosion resistance of stainless steel). Nickel-free high manganese and nitrogen stainless steel is becoming the most active leading material used in daily life and industrial stainless steel.

However, as an active non-metallic element, N element has a great influence on its stability for replacing Ni element. That is, for nickel-free high manganese and nitrogen stainless steel after MIM process treatment or room temperature metallurgical warm rolling, it is difficult to obtain corresponding pure austenitic structure in the subsequent heat treatment process, and there will be strip-shaped ferrite or even lath martensite, which is usually addressed by solid solution treatment.

Although the solid solution treatment can provide a certain degree of austenite structure, the high temperature solid solution treatment will lead to denitrification and dechromation of the metal surface, so that the metal becomes magnetic and suffers from surface color degrading, that is, graying, rendering the existence of N element meaningless. The addition of nitrogen during solid solution treatment will lead to the increase of nitrogen content, and in turn, to the existence of chromium carbide or chromium nitride due to poor solid solubility of nitrogen in the metal at high temperature, resulting in segregation and intergranular corrosion which leads to insufficient salt spray performance.

At present, the commonly present problem in the art lies in that it is difficult to achieve good comprehensive properties for nickel-free high manganese and nitrogen stainless steel, such as non-magnetic property, salt spray performance, surface condition, hardness or the like.

SUMMARY

In view of the above problems present in existing technologies, this application proposes a vacuum solid solution method for nickel-free high manganese nitrogen stainless steel, which can realize good comprehensive properties in terms of non-magnetic property, salt spray performance, good surface condition and hardness after heat treatment.

The purpose of this application can be achieved through the following technical solutions.

In a first aspect, a vacuum solid solution method for nickel-free high manganese nitrogen stainless steel is provided. The operation steps of the vacuum solid solution method are as follows:

Step 1: placing a workpiece to be heat treated on a heat treatment rack, transferring into a vacuum heat treatment furnace, vacuumizing to $1.0E^{-2}$ Pa, initially heating to 650° C. at a speed of 5-15° C./min, and keeping the temperature for 30-90 min;

Step 2: heat homogenizing the workpiece, including heating the workpiece at a speed of 5-15° C./min speed from 650° C. to a final temperature range of 1150-1185° C., and keeping the temperature for a time period sufficient to heat homogenize the workpiece, in which the whole process of heating from 650° C. to the final temperature range is protected under high pressure nitrogen to effectively avoid evaporation of Cr, N, C and other elements as the temperature increases;

Step 3: keeping the temperature at 1150-1185° C. for 60-150 min, so that the structure is fully austenitized, and the Cr, C and N compounds are fully dissolved into the austenite lattice to form supersaturated solid-solution austenitic structure;

Step 4: deoxidizing the surface of the workpiece to keep the natural metal color of the workpiece, while achieving desired salt spray and magnetic properties; and Step 5: rapid cooling treatment, including cooling the workpiece in nitrogen or argon with pressure≥6 Mpa to 450° C. or below, in particular, by a cooling speed of 150° C./min or above during the temperature range of 1150-850° C., so as to avoid the formation of ferrite and ensure that N element is always in supersaturated state, and by a cooling speed of 80° C./min or above during the temperature range of 650-450° C., so as to ensure sensitization temperature.

Preferably, the nickel-free high manganese and nitrogen stainless steel uses a nickel-free high manganese and nitrogen stainless steel prepared by MIM process, which has original characteristics of a density between 7.6-7.9 g/cm$^3$ and a main composition of nitrogen content≥0.70 (wt %), Cr 16.5-17.5 (wt %), Mn 10.0-12.0 (wt %), Ni≤0.1 (wt %) and Mo 3.0-3.5 (wt %).

Preferably, the heating process in Step 2 includes heating from 650° C. to 850° C. at a speed of 5-15° C./min and keeping the temperature for 30-90 min; heating from 850° C. to 1050° C. at a speed of 5-15° C./min and keeping the temperature for 30-90 min; and heating from 1050° C. to 1150-1185° C. at a speed of 5-15° C./min.

Because the workpiece is treated under high pressure nitrogen for a long time, a layer of oxide will be formed on the surface even in a high purity nitrogen, which makes the workpiece gray and lose the original metal color, and seriously degrades the appearance and salt spray performance. Therefore, a deoxidation treatment is needed before cooling.

In Step 4, the process of deoxidizing the surface of the workpiece includes vacuumizing to about 1.8 Pa 15-20 minutes before the cooling treatment, until the cooling treatment is performed, which can be effectively deoxidize the surface of the workpiece.

Preferably, in order not to produce an N-poor region, in Step 4, the vacuum is kept for 10-20 min, and then the nitrogen is filled to a normal partial pressure of 0.3 MPa, so that the original metal color can be maintained, while achieving desired salt spray and magnetic properties.

In a second aspect, a vacuum solid solution method for nickel-free high manganese nitrogen stainless steel is provided. The operation steps of the vacuum solid solution method are as follows:

Step 1: vacuumizing a workpiece to be heat under heating conditions;

Step 2: heating the workpiece from 650° C. to a final temperature range of 1150–1185° C. in stages at a speed of 5-15° C./min under the protection of nitrogen;

Step 3: keeping the temperature of the workpiece at 1150-1185° C. for 60-150 min;

Step 4: deoxidizing the surface of the workpiece; and

Step 5: performing rapid cooling treatment to the workpiece under nitrogen or argon.

Compared with existing technologies, the vacuum solid solution method of nickel-free high manganese and nitrogen stainless steel according to the present application has the following advantages.

From the perspective of structural materials and making full use of composition characteristics of the materials, the present application adopts a vacuum solid solution heat treatment process to form single austenitic structure from the raw materials and promote full and uniform dispersion of nitrogen carbide, providing a nickel-free high nitrogen stainless steel with more stable comprehensive performance and wider range of application. The products treated by this method will be non-magnetic, and have an appearance with natural metal color, high corrosion resistance, high hardness, and good comprehensive performance.

DESCRIPTION OF THE EMBODIMENTS

Figure 1:
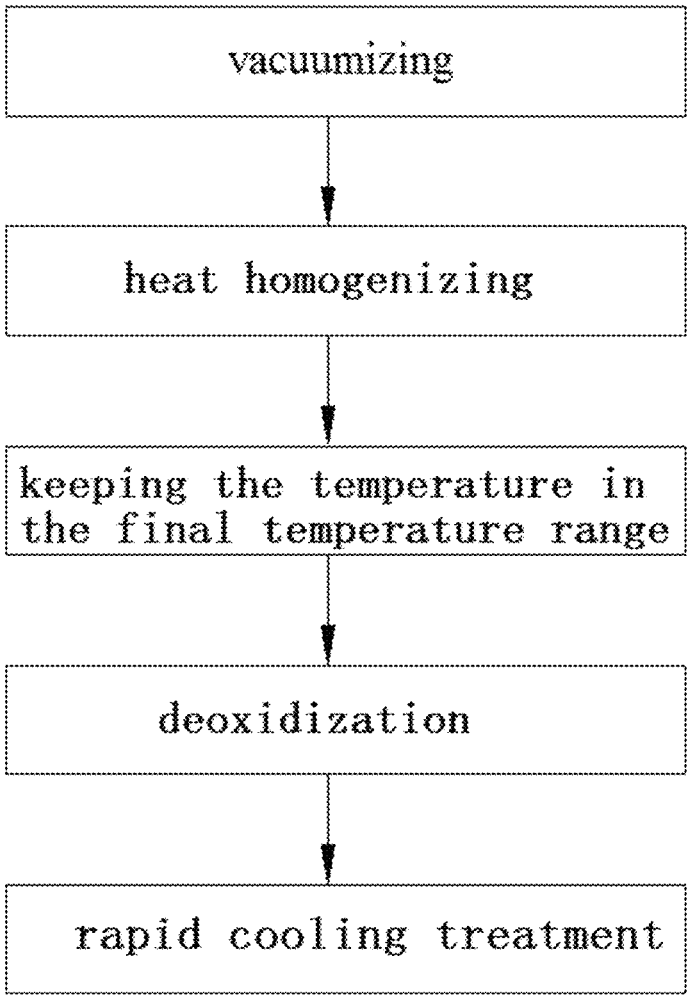
FIG. 1 is a schematic diagram of the operation flow of the present application.

The technical solution of the present application will be further described in detail in combination with the Detailed Description.

The embodiments of the present application will be described in detail below. Examples of the embodiments are shown in the drawings, in which same or similar signs throughout the description denote the same or similar elements or elements with the same or similar functions. The embodiments described below with reference to the drawings are exemplary, merely for the purpose of illustrating the present application, and should not be understood as any limitation to the present application.

Referring to FIG. 1, the present application provides a vacuum solid solution method for nickel-free high manganese and nitrogen stainless steel, which is made by MIM process from nickel-free high manganese and nitrogen stainless steel as raw material. The operation steps of the vacuum solid solution method are as follow:

Step 1: placing a workpiece to be heat treated on a heat treatment rack, transferring into a vacuum heat treatment furnace, vacuumizing to $1.0E^{-2}$ Pa, initially heating to 650° C. at a speed of 5-15° C./min, and keeping the temperature for 30-90 min;

Step 2: heat homogenizing the workpiece, including heating the workpiece at a speed of 5-15° C./min speed from 650° C. to a final temperature range of 1150-1185° C., and keeping the temperature for a time period sufficient to heat homogenize the workpiece, in which the whole process of heating from 650° C. to the final temperature range is protected under high pressure nitrogen to effectively avoid evaporation of Cr, N, C and other elements as the temperature increases;

Step 3: keeping the temperature at 1150-1185° C. for 60-150 min, so that the structure is fully austenitized, and Cr, C and N compounds are fully dissolved into the austenite lattice to form supersaturated solid-solution austenitic structure;

Step 4: deoxidizing the surface of the workpiece to keep natural metal color of the workpiece, while achieving desired salt spray and magnetic properties; and Step 5: rapid cooling treatment, including cooling the workpiece in nitrogen or argon with pressure≥6 Mpa to 450° C. or below, in particular, by a cooling speed of 150° C./min or above during the temperature range of 1150-850° C., so as to avoid the formation of ferrite and ensure that N element is always in supersaturated state, and by a cooling speed of 80° C./min or above during the temperature range of 650-450° C., so as to ensure sensitization temperature.

The nickel-free high manganese and nitrogen stainless steel has original characteristics of a density between 7.6-7.9 g/cm$^3$ and a main composition of nitrogen content≥0.70 (wt %), Cr 16.5-17.5 (wt %), Mn 10.0-12.0 (wt %), Ni≤0.1 (wt %) and Mo 3.0-3.5 (wt %).

The heating process in Step 2 includes heating from 650° C. to 850° C. at a speed of 5-15° C./min and keeping the temperature for 30-90 min; heating from 850° C. to 1050° C. at a speed of 5-15° C./min and keeping the temperature for 30-90 min; and heating from 1050° C. to 1150-1185° C. at a speed of 5-15° C./min.

Because the workpiece is treated under high pressure nitrogen for a long time, a layer of oxide will be formed on the surface even in a high purity nitrogen, which makes the workpiece gray and lose its original metal color, and seriously degrades the appearance and salt spray performance. Therefore, a deoxidation treatment is needed before cooling.

In Step 4, the process of deoxidizing the surface of the workpiece includes vacuumizing to about 1.8 Pa 15-20 minutes before the cooling treatment, until the cooling treatment is performed, which can be effectively deoxidize the surface of the workpiece.

In order not to produce an N-poor region, in Step 4, the vacuum is kept for 10-20 min, and then the nitrogen is filled to a normal partial pressure of 0.3 MPa, so that the original metal color can be maintained, while achieving desired salt spray and magnetic properties.

Workpieces formed by high-pressure injection molding from the raw material, that is, nickel-free high manganese and nitrogen stainless steel produced by MIM process, are inspected regarding the composition and size thereof, and divided into 5 groups, with 10 workpieces in each group. Each group was treated by the above method and conventional vacuum solid solution heat treatment process. The magnetic permeability, surface metallographic structure, Vickers hardness and salt spray performance of the treated workpiece were tested, respectively.

The conventional solid solution heat treatment process for nickel-free high manganese and nitrogen stainless steel includes placing the workpiece into a vacuum heat treatment furnace, vacuumizing to 1.0E$^{-2}$ Pa, heating to 1150-1185° C., keeping the temperature for 60-120 min, and cooling down by water.

Example 1

Five workpieces in group 1 were placed on a heat treatment rack, transferred into a cold wall vacuum heat treatment furnace, and treated by the following process: vacuumizing to 1.0E$^{-2}$ Pa, heating to 650° C. at a speed of 5-15° C./min, keeping the temperature for 60 min, heating to 850° C. at a speed of 5-15° C./min under the protection of high nitrogen pressure, keeping the temperature for 60 min, heating to 1050° C. at a speed of 5-15° C./min, keeping the temperature for 60 min, heating to 1150° C. at a speed of 5-15° C./min, keeping the temperature for 90 min, removing surface oxidation, and rapidly cooling to 80° C. in nitrogen with pressure≥6 Mpa.

Figure 2:
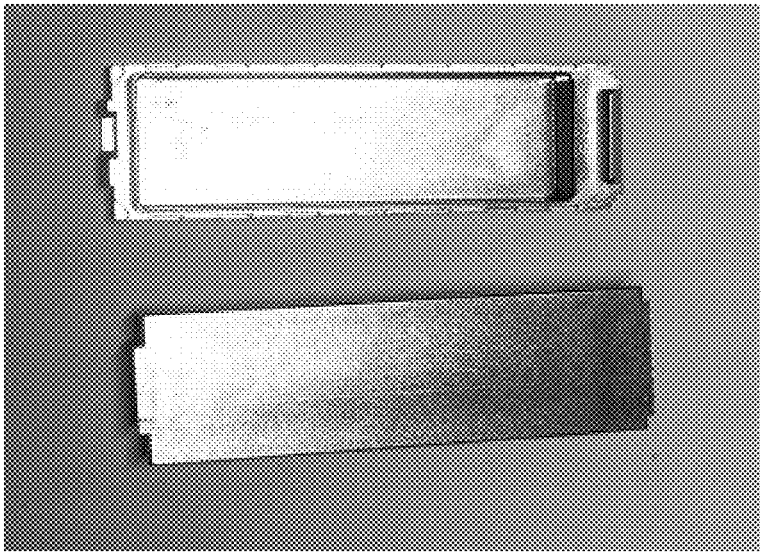
FIG. 2 is the surface state diagram of the workpiece after heat treatment by the method of the present application in Example 1.
Figure 4:
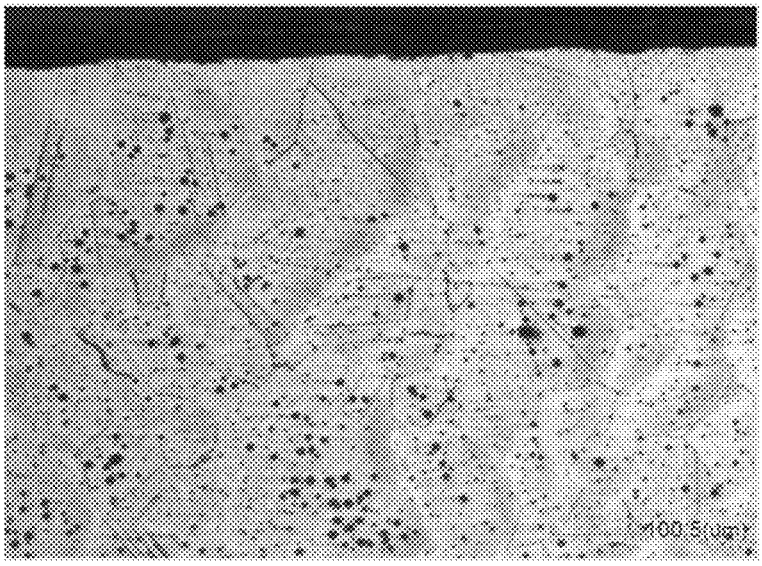
FIG. 4 is the metallographic structure state diagram of the workpiece after heat treatment by the method of the present application in Example 1.

As shown in FIG. 2, after the above heat treatment, the surface of the workpiece presents the natural color of metal and austenitic metallographic structure according to analysis, the state of which is shown in FIG. 4. The permeability of the workpiece is ≤1.01H/m as measured by a magnetic permeameter, the hardness is between 285-320 HV as measured by a Vickers hardness tester (the hardness meets universal requirements), and there is no abnormality after neutral salt spray test for 48 hours.

Figure 3:
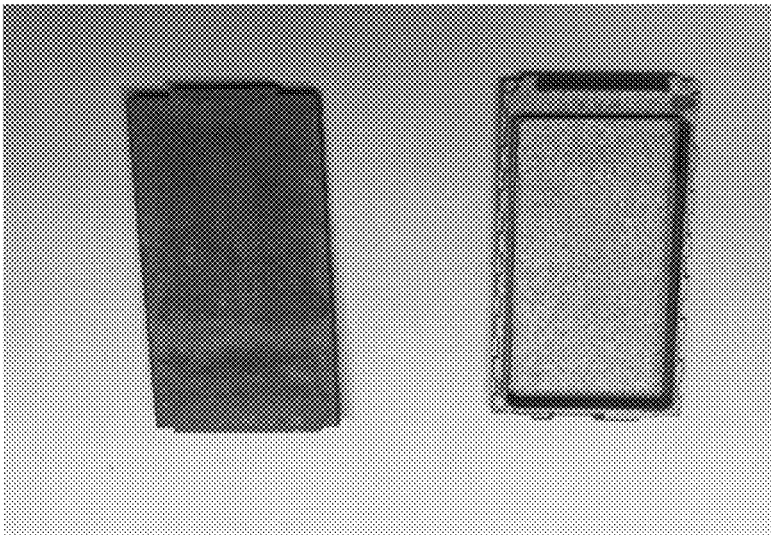
FIG. 3 is the surface state diagram of the workpiece after heat treatment by conventional vacuum solid solution process in Example 1.
Figure 5:
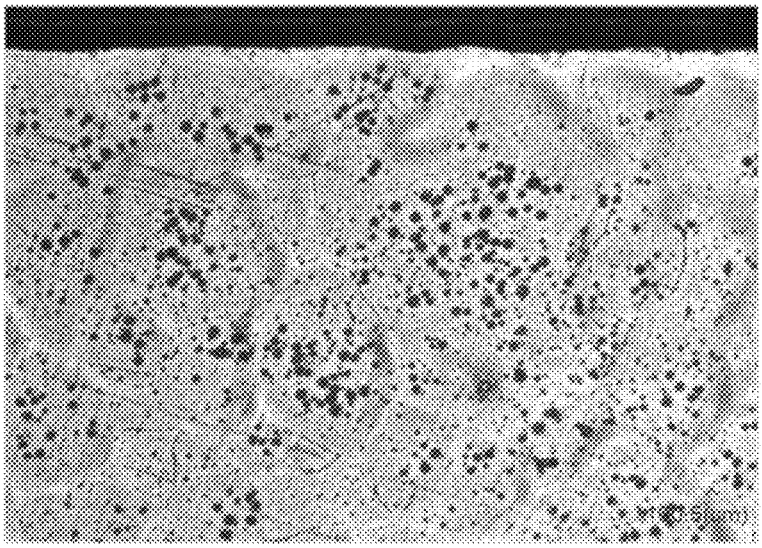
FIG. 5 is the metallographic structure state diagram of the workpiece after heat treatment by common vacuum solid solution process in Example 1.

The other five workpieces in this group were heat treated by conventional vacuum solid solution process, in which the temperature keeping time was set as 90 min. After heat treatment, the surface of the workpieces turned gray, as shown in FIG. 3. The metallographic structure analysis showed that there was ferrite, as shown in FIG. 5. The magnetic conductivity of the workpiece was between 1.05-1.08H/m as measured by a magnetic permeameter, the hardness is between 350-380 HV as measured by a Vickers hardness tester, and the workpiece was rusted in neutral salt spray environment in only 20 hours.

Example 2

Five workpieces in group 2 were placed on a heat treatment rack, transferred into a cold wall vacuum heat treatment furnace, and treated by the following process: vacuumizing to 1.0E$^{-2}$ Pa, heating to 650° C. at a speed of 5-15° C./min, keeping the temperature for 90 min, heating to 850° C. at a speed of 5-15° C./min under the protection of high nitrogen pressure, keeping the temperature for 90 min, heating to 1050° C. at a speed of 5-15° C./min, keeping the temperature for 90 min, heating to 1150° C. at a speed of 5-15° C./min, keeping the temperature for 120 min, removing surface oxidation, and rapidly cooling to 80° C. in nitrogen with pressure≥6 Mpa.

Figure 6:
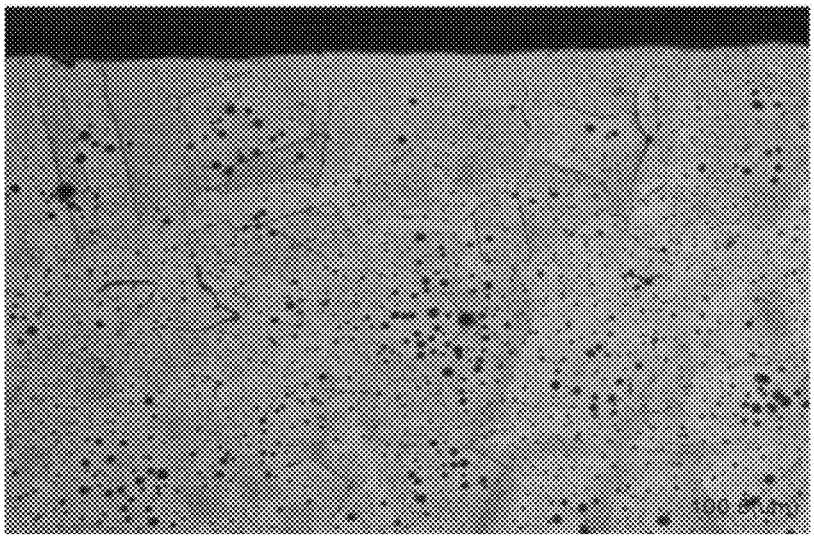
FIG. 6 is the metallographic structure state diagram of the workpiece after heat treatment by the method of the present application in Example 2.

After the above heat treatment, the surface of the workpiece presents the natural color of metal and austenitic metallographic structure according to analysis, the state of which is shown in FIG. 6. The permeability of the workpiece is ≤1.01H/m as measured by a magnetic permeameter, the hardness is between 285-320 HV as measured by a Vickers hardness tester (the hardness meets universal requirements), and there is no abnormality after neutral salt spray test for 48 hours.

Figure 7:
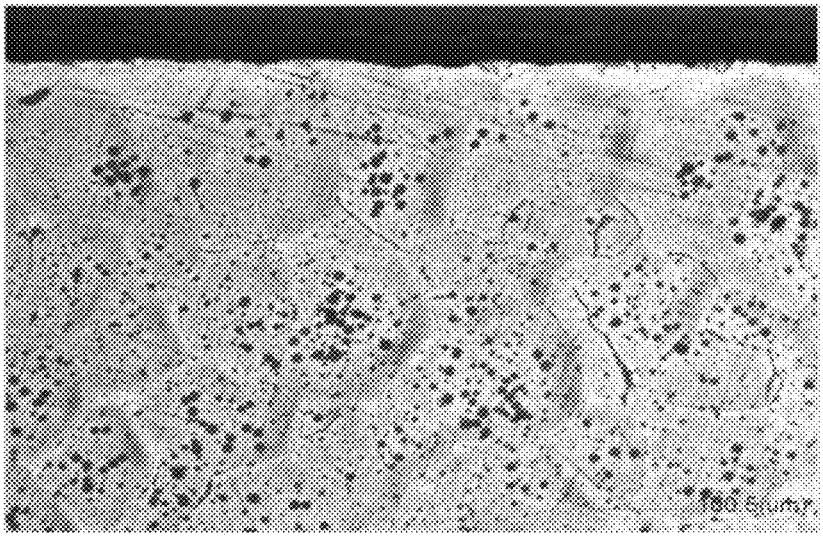
FIG. 7 is the metallographic structure state diagram of the workpiece after heat treatment by conventional vacuum solid solution process in Example 2.

The other five workpieces in this group were heat treated by conventional vacuum solid solution process, in which the temperature keeping time was set as 90 min. After heat treatment, the surface of the workpieces turned gray. The metallographic structure analysis showed that there was ferrite, as shown in FIG. 7. The magnetic conductivity of the workpiece was between 1.05-1.07H/m as measured by a magnetic permeameter, the hardness is between 350-370 HV as measured by a Vickers hardness tester, and the workpiece was rusted in neutral salt spray environment in only 20 hours.

Example 3

Five workpieces in group 3 were placed on a heat treatment rack, transferred into a cold wall vacuum heat treatment furnace, and treated by the following process: vacuumizing to 1.0E$^{-2}$ Pa, heating to 650° C. at a speed of 5-15° C./min, keeping the temperature for 30 min, heating to 850° C. at a speed of 5-15° C./min under the protection of high nitrogen pressure, keeping the temperature for 30 min, heating to 1050° C. at a speed of 5-15° C./min, keeping the temperature for 30 min, heating to 1150° C. at a speed of 5-15° C./min, keeping the temperature for 60 min, removing surface oxidation, and rapidly cooling to 80° C. in nitrogen with pressure≥6 Mpa.

Figure 8:
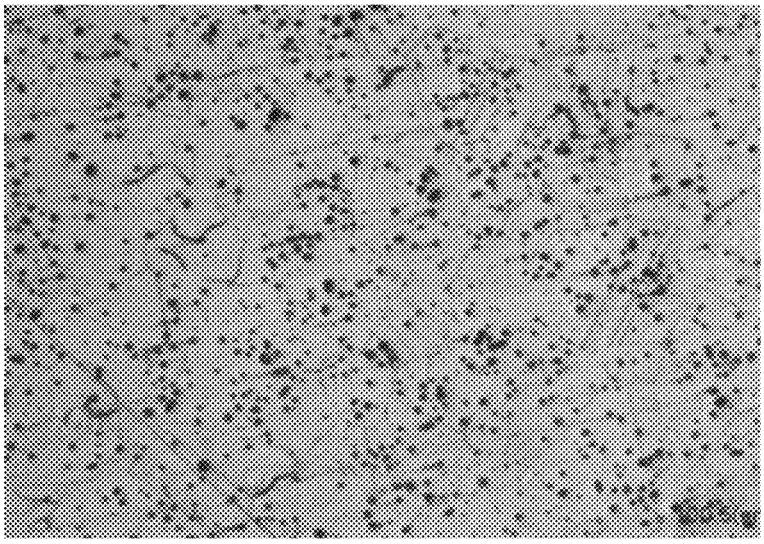
FIG. 8 is the metallographic structure state diagram of the workpiece after heat treatment by the method of the present application in Example 3.

After the above heat treatment, the surface of the workpiece presents the natural color of metal and austenitic metallographic structure according to analysis, the state of which is shown in FIG. 8. The permeability of the workpiece is ≤1.01H/m as measured by a magnetic permeameter, the hardness is between 290-320 HV as measured by a Vickers hardness tester (the hardness meets universal requirements), and there is no abnormality after neutral salt spray test for 48 hours.

Figure 9:
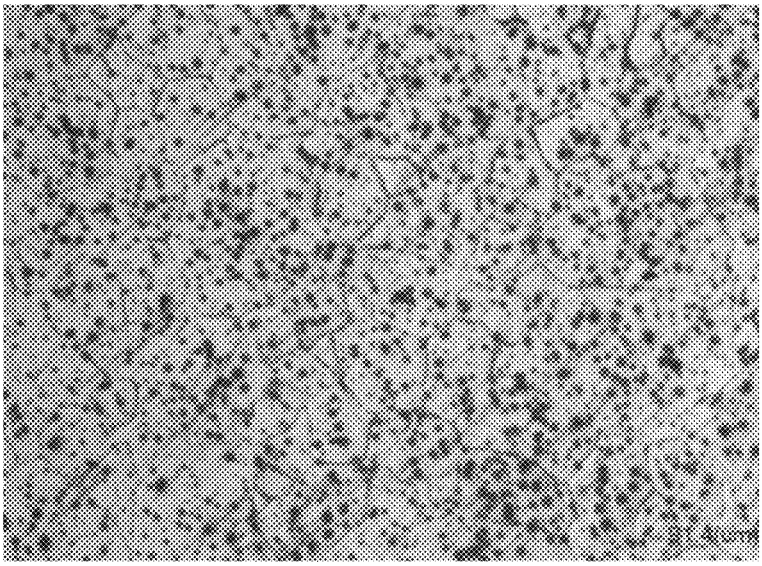
FIG. 9 is the metallographic structure state diagram of the workpiece after heat treatment by conventional vacuum solid solution process in Example 3.

The other five workpieces in this group were heat treated by conventional vacuum solid solution process, in which the temperature keeping time was set as 60 min. After heat treatment, the surface of the workpieces turned gray. The metallographic structure analysis showed that there was ferrite, as shown in FIG. 9. The magnetic conductivity of the workpiece was between 1.06-1.08H/m as measured by a magnetic permeameter, the hardness is between 360-380 HV as measured by a Vickers hardness tester, and the workpiece was rusted in neutral salt spray environment in only 18 hours.

Example 4

Five workpieces in group 4 were placed on a heat treatment rack, transferred into a cold wall vacuum heat treatment furnace, and treated by the following process: vacuumizing to $1.0E^{-2}$ Pa, heating to 650° C. at a speed of 5-15° C./min, keeping the temperature for 60 min, heating to 850° C. at a speed of 5-15° C./min under the protection of high nitrogen pressure, keeping the temperature for 60 min, heating to 1050° C. at a speed of 5-15° C./min, keeping the temperature for 60 min, heating to 1150° C. at a speed of 5-15° C./min, keeping the temperature for 150 min, removing surface oxidation, and rapidly cooling to 80° C. in nitrogen with pressure≥6 Mpa.

Figure 10:
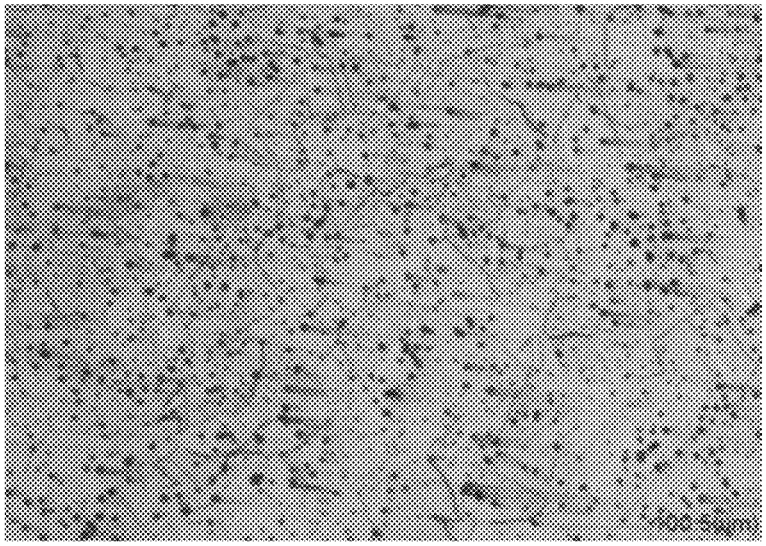
FIG. 10 is the metallographic structure state diagram of the workpiece after heat treatment by the method of the present application in Example 4.

After the above heat treatment, the surface of the workpiece presents the natural color of metal and austenitic metallographic structure according to analysis, the state of which is shown in FIG. 10. The permeability of the workpiece is ≤1.01H/m as measured by a magnetic permeameter, the hardness is between 285-310 HV as measured by a Vickers hardness tester (the hardness meets universal requirements), and there is no abnormality after neutral salt spray test for 48 hours.

Figure 11:
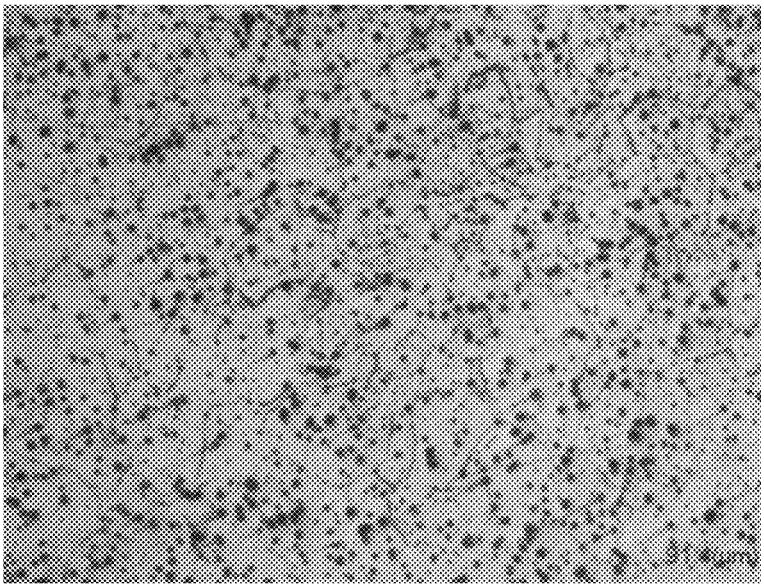
FIG. 11 is the metallographic structure state diagram of the workpiece after heat treatment by conventional vacuum solid solution process in Example 4.

The other five workpieces in this group were heat treated by conventional vacuum solid solution process, in which the temperature keeping time was set as 150 min. After heat treatment, the surface of the workpieces turned gray. The metallographic structure analysis showed that there was ferrite, as shown in FIG. 11. The magnetic conductivity of the workpiece was between 1.05-1.07H/m as measured by a magnetic permeameter, the hardness is between 350-370 HV as measured by a Vickers hardness tester, and the workpiece was rusted in neutral salt spray environment in only 20 hours.

Example 5

Five workpieces in group 4 were placed on a heat treatment rack, transferred into a cold wall vacuum heat treatment furnace, and treated by the following process: vacuumizing to $1.0E^{-2}$ Pa, heating to 650° C. at a speed of 5-15° C./min, keeping the temperature for 40 min, heating to 850° C. at a speed of 5-15° C./min under the protection of high nitrogen pressure, keeping the temperature for 50 min, heating to 1050° C. at a speed of 5-15° C./min, keeping the temperature for 50 min, heating to 1150° C. at a speed of 5-15° C./min, keeping the temperature for 100 min, removing surface oxidation, and rapidly cooling to 80° C. in nitrogen with pressure≥6 Mpa.

Figure 12:
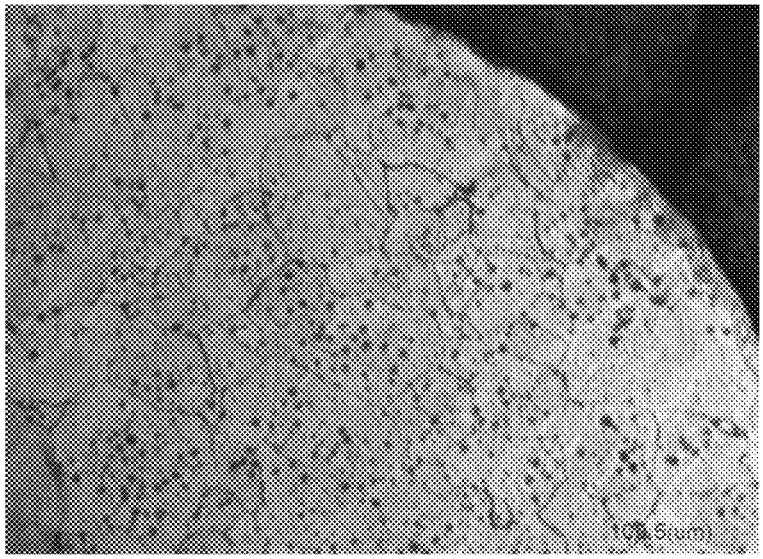
FIG. 12 is the metallographic structure state diagram of the workpiece after heat treatment by the method of the present application in Example 5.

After the above heat treatment, the surface of the workpiece presents the natural color of metal and austenitic metallographic structure according to analysis, the state of which is shown in FIG. 12. The permeability of the workpiece is ≤1.01H/m as measured by a magnetic permeameter, the hardness is between 280-315 HV as measured by a Vickers hardness tester (the hardness meets universal requirements), and there is no abnormality after neutral salt spray test for 48 hours.

Figure 13:
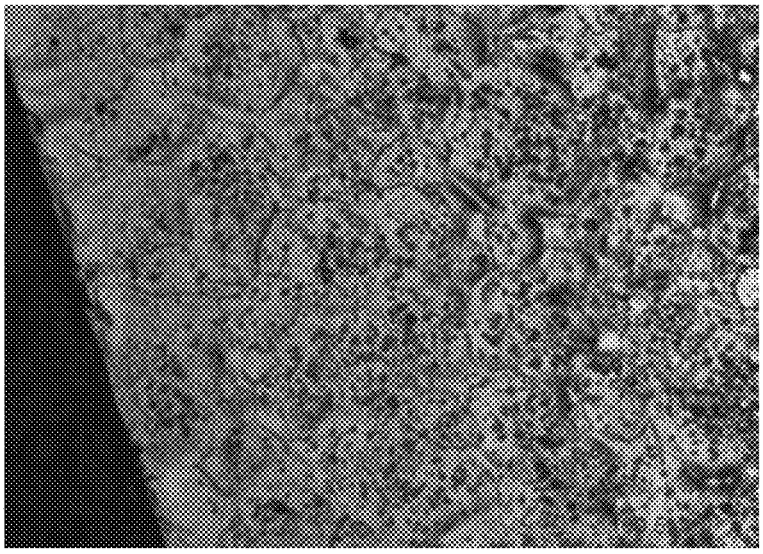
FIG. 13 is the metallographic structure state diagram of the workpiece after heat treatment by conventional vacuum solid solution process in example 5.

The other five workpieces in this group were heat treated by conventional vacuum solid solution process, in which the temperature keeping time was set as 100 min. After heat treatment, the surface of the workpieces turned gray. The metallographic structure analysis showed that there was ferrite, as shown in FIG. 13. The magnetic conductivity of the workpiece was between 1.05-1.07H/m as measured by a magnetic permeameter, the hardness is between 360-380 HV as measured by a Vickers hardness tester, and the workpiece was rusted in neutral salt spray environment in only 19 hours.

From the comparative analysis of the test results of the above examples, it can be seen that the surface of the nickel-free high manganese and nitrogen stainless steel after heat treatment with the vacuum solid solution method provided by the present application will show the natural luster of metal, austenitic metallographic structure according to analysis, a permeability of ≤1.01μ, and a Vickers hardness between 280-320 hv. Although the hardness is relatively lower than that of the steel obtained by conventional vacuum solid solution process, it still meets the universal requirements of hardness for nickel-free high manganese and nitrogen stainless steel and has no abnormality after neutral salt spray test for 48 hours.

To sum up, the method provided in the application can form single austenitic structure from the raw materials and promote full and uniform dispersion of nitrogen carbide, providing a nickel-free high nitrogen stainless steel with more stable comprehensive performance and wider range of application. The products treated by this method will be non-magnetic, and have an appearance with natural metal color, high corrosion resistance, high hardness, and good comprehensive performance.

The preferred implementation mode of the patent is described in detail above, but the patent is not limited to the above embodiments. Within the scope of knowledge possessed by ordinary technicians in the art, various changes can be made without departing from the spirit of the present application.

What is claimed is:

1. A vacuum solid solution method for stainless steel, comprising:

step 1: placing a workpiece comprising nickel-free manganese and nitrogen stainless steel to be heat treated into a vacuum heat treatment furnace, vacuumizing to $1.0E^{-2}$ Pa, initially heating to 650° C. at a speed of 5-15° C./min, and maintaining a temperature of 650° C. for 30-90 min, wherein the nickel-free manganese and nitrogen stainless steel has a nitrogen content of greater than or equal to 0.70 wt % and a manganese content of 10.0-12.0 wt %;

step 2: heat homogenizing the workpiece, comprising heating the workpiece at a speed of 5-15° C./min from 650° C. to a final temperature range of 1150-1185° C. in stages, wherein a whole process of heating from 650° C. to the final temperature range is protected under nitrogen;

step 3: maintaining a temperature of 1150-1185° C. for 60-150 min;

step 4: deoxidizing a surface of the workpiece; and step 5: performing a rapid cooling treatment, comprising cooling the workpiece in nitrogen or argon with pressure greater than or equal to 6 Mpa to 450° C. or below by a cooling speed of 150° C./min or above during a temperature range of 1150-850° C., and by a cooling speed of 80° C./min or above during a temperature range of 650-450° C.

2. The vacuum solid solution method for stainless steel according to claim 1, wherein the stainless steel uses a stainless steel prepared by a Metal Injection Molding (MIM) process as raw material, and has original characteristics of a density between 7.6-7.9 g/cm$^3$ and comprising chromium in a range of 16.5-17.5 wt %, less than or equal to 0.1 wt % of nickel and molybdenum in a range of 3.0-3.5 wt %.

3. The vacuum solid solution method for stainless steel according to claim 2, wherein the heating in the step 2 comprises heating from 650° C. to 850° C. at a speed of 5-15° C./min and maintaining a temperature of 850° C. for 30-90 min; heating from 850° C. to 1050° C. at a speed of 5-15° C./min and maintaining a temperature of 1050° C. for 30-90 min; and heating from 1050° C. to 1150-1185° C. at a speed of 5-15° C./min.

4. The vacuum solid solution method for stainless steel according to claim 2, wherein, in the step 4, a process of deoxidizing the surface of the workpiece comprises vacuumizing to 1.8 Pa for 15-20 minutes before the rapid cooling treatment, until the rapid cooling treatment is performed.

5. The vacuum solid solution method for stainless steel according to claim 4, wherein, in the step 4, the vacuumizing is maintained for 10-20 min, and then the nitrogen is filled to a normal partial pressure of 0.3 MPa.

* * * * *